US012038173B2

(12) United States Patent
Wailgum

(10) Patent No.: US 12,038,173 B2
(45) Date of Patent: Jul. 16, 2024

(54) COAL-FIRED POWER GENERATION SYSTEM AND AIR HEAT WITH RECIRCULATION PATH AND RELATED METHOD

(71) Applicant: Orlando Utilities Commission, Orlando, FL (US)

(72) Inventor: Jason Wailgum, Orlando, FL (US)

(73) Assignee: ORLANDO UTILITIES COMMISSION, Orlando, FL (US)

( * ) Notice: Subject to any disclaimer, the term of this patent is extended or adjusted under 35 U.S.C. 154(b) by 433 days.

(21) Appl. No.: 17/454,656

(22) Filed: Nov. 12, 2021

(65) Prior Publication Data

US 2023/0151964 A1 May 18, 2023

(51) Int. Cl.

| | |
|---|---|
| ***F23N 3/04*** | (2006.01) |
| ***F23D 1/00*** | (2006.01) |
| ***F23L 3/00*** | (2006.01) |
| ***F23L 15/04*** | (2006.01) |

(52) U.S. Cl.

CPC ..... *F23N 3/042* (2013.01); *F23D 1/00* (2013.01); *F23L 3/00* (2013.01); *F23L 15/04* (2013.01); *F23N 2225/08* (2020.01)

(58) Field of Classification Search

CPC ..... F23L 15/04; F23N 3/042; F23N 2225/21; F23N 2225/08; F23D 1/00; F23K 3/00; F23K 2201/10

See application file for complete search history.

(56) References Cited

U.S. PATENT DOCUMENTS

| | | | | |
|---|---|---|---|---|
| 1,652,025 | A | 12/1927 | Ljungstrom | |
| 9,457,353 | B2 | 10/2016 | Dunst | |
| 10,352,246 | B2 * | 7/2019 | Sumimura | F22D 1/14 |
| 2006/0107587 | A1 * | 5/2006 | Bullinger | F26B 3/082 44/629 |
| 2006/0199134 | A1 * | 9/2006 | Ness | F23K 1/04 432/121 |
| 2013/0244190 | A1 * | 9/2013 | Marumoto | F23L 15/04 110/301 |
| 2013/0319299 | A1 * | 12/2013 | Handa | F23N 3/002 110/297 |
| 2016/0238245 | A1 * | 8/2016 | Okamoto | F23L 15/04 |

* cited by examiner

*Primary Examiner* — Ko-Wei Lin

(74) *Attorney, Agent, or Firm* — ALLEN, DYER, DOPPELT, + GILCHRIST, P.A.

(57) ABSTRACT

A coal-fired power generation system may include a boiler outputting flue gas, a coal pulverizer associated with the boiler, and a heat exchanger. The heat exchanger may be configured to exchange heat from the flue gas to a primary air path and a secondary air path. The primary air path is coupled to the coal pulverizer, and the secondary air path is coupled to the boiler. The coal-fired power generation system may include a controllable air recirculation path coupled from an output of the primary air path to an input of the secondary air path.

21 Claims, 3 Drawing Sheets

COAL-FIRED POWER GENERATION SYSTEM AND AIR HEAT WITH RECIRCULATION PATH AND RELATED METHOD

TECHNICAL FIELD

The present disclosure relates to the field of power generation, and, more particularly, to coal fire power generation and related methods.

BACKGROUND

In the power generation industry, coal typically used to generate electricity is dried, pulverized into a fine powder, and fed into a boiler to be burned. The resulting combustion is used to generate heat, then steam, and electricity.

A pulverizer is typically used to crush and dry the coal. For a typical coal pulverizer, coal is fed into the center of a rotating table, and three metal rollers push down on the table to exert many tons of pressure onto the table. As the table rotates, the coal moves outward and under the rollers where it is pulverized. During this pulverizing process, hot air is blown through the milling area of the pulverizer to dry and transport resulting coal dust out of the pulverizer. At the top of the pulverizer, a mechanical classification takes place where any uncrushed coal is sent back to the center of the table and crushed again, and fine grained coal is blown out of the pulverizer to the boiler for combustion.

The hot air blown into the pulverizer is generated at least partially by an air heater. For example, an exemplary air heater is available from Ljungstrom Technology AB. In some approaches, thermal energy is recovered from flue gas exiting the boiler and used to heat input air for the coal pulverizer.

SUMMARY

Generally, a coal-fired power generation system may include a boiler outputting flue gas, a coal pulverizer associated with the boiler, and a heat exchanger configured to exchange heat from the flue gas to a primary air path and a secondary air path. The primary air path is coupled to the coal pulverizer, and the secondary air path is coupled to the boiler. The coal-fired power generation system may include a controllable air recirculation path coupled from an output of the primary air path to an input of the secondary air path.

In some embodiments, the controllable air recirculation path may comprise an air recirculation duct, and a damper therein. The coal-fired power generation system may comprise a controller coupled to the damper and configured to control the damper based upon respective temperatures of the output of the primary air path and an output of the secondary air path. The controllable air recirculation path may comprise an air recirculation duct, and an expansion joint therein. The coal-fired power generation system may include a plurality of temperature sensors respectively coupled to the primary air path, and the secondary air path. The input of the secondary air path may be configured to receive heated ambient air, and the input of the primary air path may be configured to receive ambient air.

Additionally, the coal-fired power generation system may include an exhaust stack configured to receive the flue gas from the heat exchanger. The controllable air recirculation path may have a flow rate less than 10% of the input of the secondary air path.

Another aspect is directed to an air heater for a coal-fired power generation system comprising a boiler outputting flue gas, and a coal pulverizer associated with the boiler. The air heater may include a heat exchanger configured to exchange heat from the flue gas to a primary air path and a secondary air path. The primary air path is coupled to the coal pulverizer, and the secondary air path is coupled to the boiler. The air heater may include a controllable air recirculation path coupled from an output of the primary air path to an input of the secondary air path.

Yet another aspect is directed to a method for operating a coal-fired power generation system comprising a boiler outputting flue gas, and a coal pulverizer associated with the boiler. The method may comprise exchanging heat from the flue gas to a primary air path and a secondary air path using a heat exchanger. The primary air path is coupled to the coal pulverizer, and the secondary air path is coupled to the boiler. The method may comprise controlling an air recirculation path coupled from an output of the primary air path to an input of the secondary air path.

DETAILED DESCRIPTION

Figure 1:
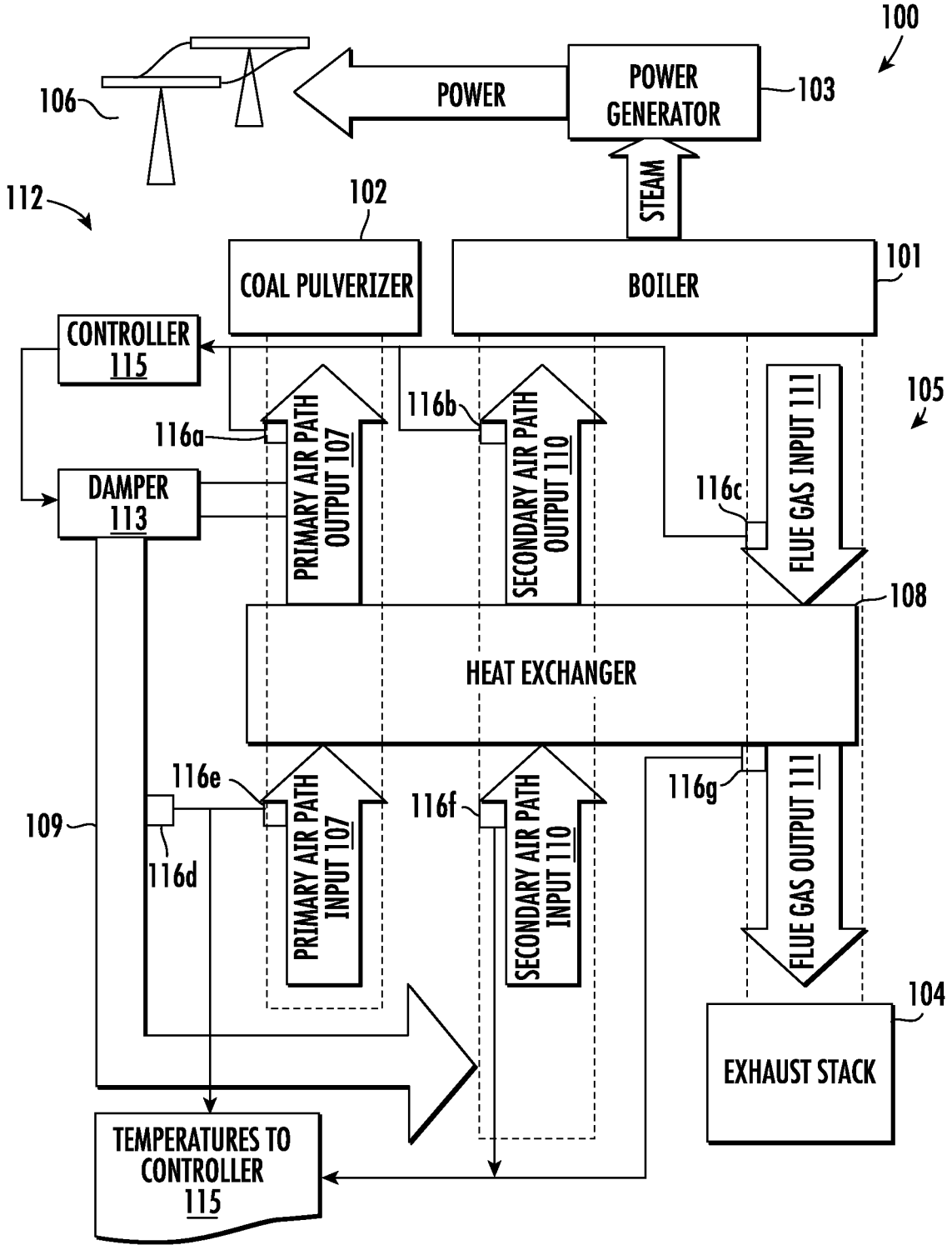
FIG. 1 is a schematic diagram of a coal-fired power generation system, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

As will be appreciated, in typical approaches, available hot primary air temperature is generated by the air heater and sent to the coal pulverizer for coal drying and transportation. This hot primary air is typically moderated by tempering air, which cools the hot primary air to meet the appropriate inlet mill temperature. The amount of tempering air required is a function of coal moisture and coal pulverizer outlet temperature set-point. The tempering air (cold primary air) may be necessary for keeping the pulverizer inlet temperature from exceeding a recommended value, otherwise a mill/pulverizer fire and/or damage to the pulverizer can occur.

In typical air heaters, heat is recovered from flue gas. For example, at full load, a typical air heater may recover on average ~448 MBtu/hr of energy from the flue gas for the burners and coal pulverizers. This is the equivalent to ~10.4% of total net heat input duty per air heater. Moreover, changes to plant operation from ambient conditions, pressure part/heat transfer equipment upgrades, and fuel switches, etc., may alter the operating conditions around the air heater and coal pulverizers, changing this energy recovery figure.

Unfortunately, the typical approaches may not be energy efficient, which increases cost for power generation. For example, the representative total energy wasted by the air heater when firing 10% moisture coal includes tempering air and additional primary air flow scavenging on the order of 225,000 Lb/hr. Moreover, this amount of flow in energy terms is equivalent to nearly ~48.6 MBtu/hr, or 1.9 total petroleum hydrocarbons of coal.

Referring to FIG. 1, a coal-fired power generation system 100 according to the present disclosure is now described. The coal-fired power generation system 100 may provide an approach to the above issues of typical air heaters.

The coal-fired power generation system 100 illustratively includes a boiler 101 outputting flue gas and steam, and a coal pulverizer 102 associated with the boiler. As will be appreciated, the coal pulverizer 102 is configured to process coal into a powder form, which is more readily combusted. The boiler 101 is configured to generate the steam from the combustion of the processed coal. The coal-fired power generation system 100 illustratively includes a power generator 103 coupled to receive the steam from the boiler 101. The power generator 103 may comprise steam turbines and an electrical generator driven by the stream turbines. The electrical power from the power generator 103 is delivered to an illustrated power grid 106.

The coal-fired power generation system 100 illustratively includes an exhaust stack 104 receiving the flue gas from the boiler 101. The coal-fired power generation system 100 illustratively includes an air heater 105 coupled to the boiler 101, the coal pulverizer 102, and the exhaust stack 104. As will be appreciated, the air heater 105 is configured to heat the processed coal to reduce moisture. This process is disclosed in detail within U.S. Pat. No. 9,457,353 to Dunst, assigned to the present application's assignee.

The air heater 105 is configured to exchange heat from the flue gas to a primary air path 107 and a secondary air path 110, sourcing the flue gas from a tertiary air path 111. The primary air path 107 has an output coupled to the coal pulverizer 102, and an input coupled to receive ambient air. The secondary air path 110 has an output coupled to the boiler 101 (i.e. the lower pressure boiler combustion air inlet), and an input coupled to receive heated ambient air (i.e. air heated by the air heater 105 heating elements, for example, electrical heating elements, separate from the heat exchanger mechanism). As will be appreciated, the source of the primary air path 107 and the secondary air path 110 comprises the same unheated air from ambient conditions. Nonetheless, the temperature of the input of the primary air path 107 is greater than the temperature of the input of the secondary air path 110. This is because of fan static pressure causing compression of air and as a result, a temperature rise. Typically, for every 1" w.g. of pressure rise ((static pressure class) caused by a fan yields a 0.5° F. rise in temperature. The tertiary air path 111 has an input coupled to receive the flue gas from the boiler 101, and an output coupled to exhaust the flue gas to the exhaust stack 104.

The air heater 105 illustratively comprises a heat exchanger 108 configured to exchange heat from the flue gas in the tertiary air path 111 to the primary air path 107 and the secondary air path 110. The air heater 105 comprises a controllable air recirculation path 112 coupled from an output of the primary air path 107 to an input of the secondary air path 110.

In illustrated embodiment, the controllable air recirculation path 112 comprises an air recirculation duct 109, a damper 113 within the air recirculation duct. The controllable air recirculation path 112 comprises a controller 115 coupled to the damper 113. As will be appreciated, the output of the primary air path 107 comprises a 50" w.g. (static pressure class), and the to an input of the secondary air path 110 comprises 10" w.g., which creates sufficient positive flow therethrough.

The controller 115 is configured to the damper 113 based upon respective temperatures of the output of the primary air path 107, an output of the secondary air path 110, an output of the tertiary air path 111, and a temperature within the controllable air recirculation path 112. The controllable air recirculation path 112 has a flow rate less than the input of the secondary air path 110, for example, 10%. In the illustrated embodiment, the controller 115 is also configured to control the damper 113 based upon respective temperatures of an input of the primary air path 107, the input of the secondary air path 110, and an input of the tertiary air path 111. The air heater 105 comprises a plurality of temperature sensors **116*a*-116*g* respectively coupled to the input/output of the primary air path 107, the input/output of the secondary air path 110, and the input/output of the tertiary air path 111. The controller 115 is illustratively coupled to the plurality of temperature sensors 116*a*-116*g*** and is configured to receive temperature values therefrom.

Advantageously, the air heater 105 may include a variable frequency speed controlled motor and heated air duct/damper to transform convective energy wastage into usable energy. The converted energy is transported by pressurized air and injected into the lower pressure boiler combustion air inlet. Once injected, the energy exchange may increase combustion air temperature, which improves steam plant cycle heat rate and boiler efficiency. As a result of a greater combustion air inlet temperature, the flue gas temperature leaving the air heater 105 may be increased, which results in increased water evaporation.

Another aspect is directed to an air heater 105 for a coal-fired power generation system 100 comprising a boiler 101 outputting flue gas, and a coal pulverizer 102 associated with the boiler. The air heater 105 includes a heat exchanger 108 configured to exchange heat from the flue gas to a primary air path 107 and a secondary air path 110. The primary air path 107 is coupled to the coal pulverizer 102, and the secondary air path 110 is coupled to the boiler 101. The air heater 105 includes a controllable air recirculation path 112 coupled from an output of the primary air path 107 to an input of the secondary air path 110.

Yet another aspect is directed to a method for operating a coal-fired power generation system 100 comprising a boiler 101 outputting flue gas, and a coal pulverizer 102 associated with the boiler. The method comprises exchanging heat from the flue gas to a primary air path 107 and a secondary air path 110 using a heat exchanger 108. The primary air path 107 is coupled to the coal pulverizer 102, and the secondary air path 110 is coupled to the boiler 101. The method comprises controlling an air recirculation path 112 coupled from an output of the primary air path 107 to an input of the secondary air path 110.

Figure 2:
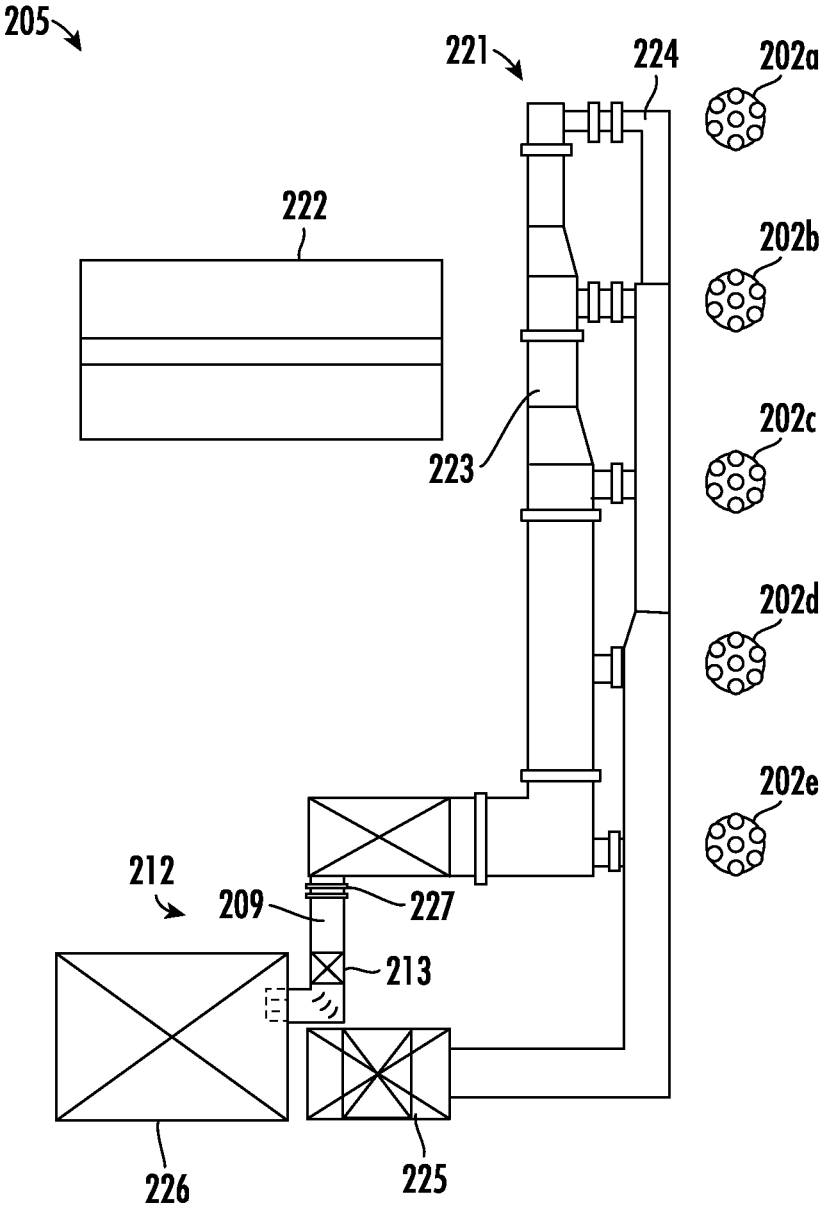
FIG. 2 is a schematic diagram of an example embodiment of the air heater from FIG. 1.

Referring now additionally to FIG. 2, another embodiment of the air heater 205 is now described. In this embodiment of the air heater 205, those elements already discussed above with respect to FIG. 1 are incremented by 100 and most require no further discussion herein. This embodiment differs from the previous embodiment in that this air heater 205 illustratively includes controllable air recirculation path 212 with a single bend. Also, this controllable air recirculation path 212 includes a plurality of ports for receiving temperature sensors. The temperature sensors are coupled to the controller, and the controller is configured to control one or both of the damper 213 based upon respective temperatures of the temperature sensors.

This air heater 205 illustratively includes a plurality of coal pulverizers 202*a*-202*e*, a sealed air duct 224, a hot primary air supply duct 223 outputting to the plurality of coal pulverizers via the sealed air duct, an air recirculation duct 209 coupled to the hot primary air supply duct, a cold secondary air inlet duct to air heater 226 coupled to the air recirculation duct, a hot primary air outlet duct 225 from a heating source, and a boiler bottom 222. The air recirculation duct 209 illustratively includes an expansion joint 227 upstream of the dampener 213.

Figure 3:
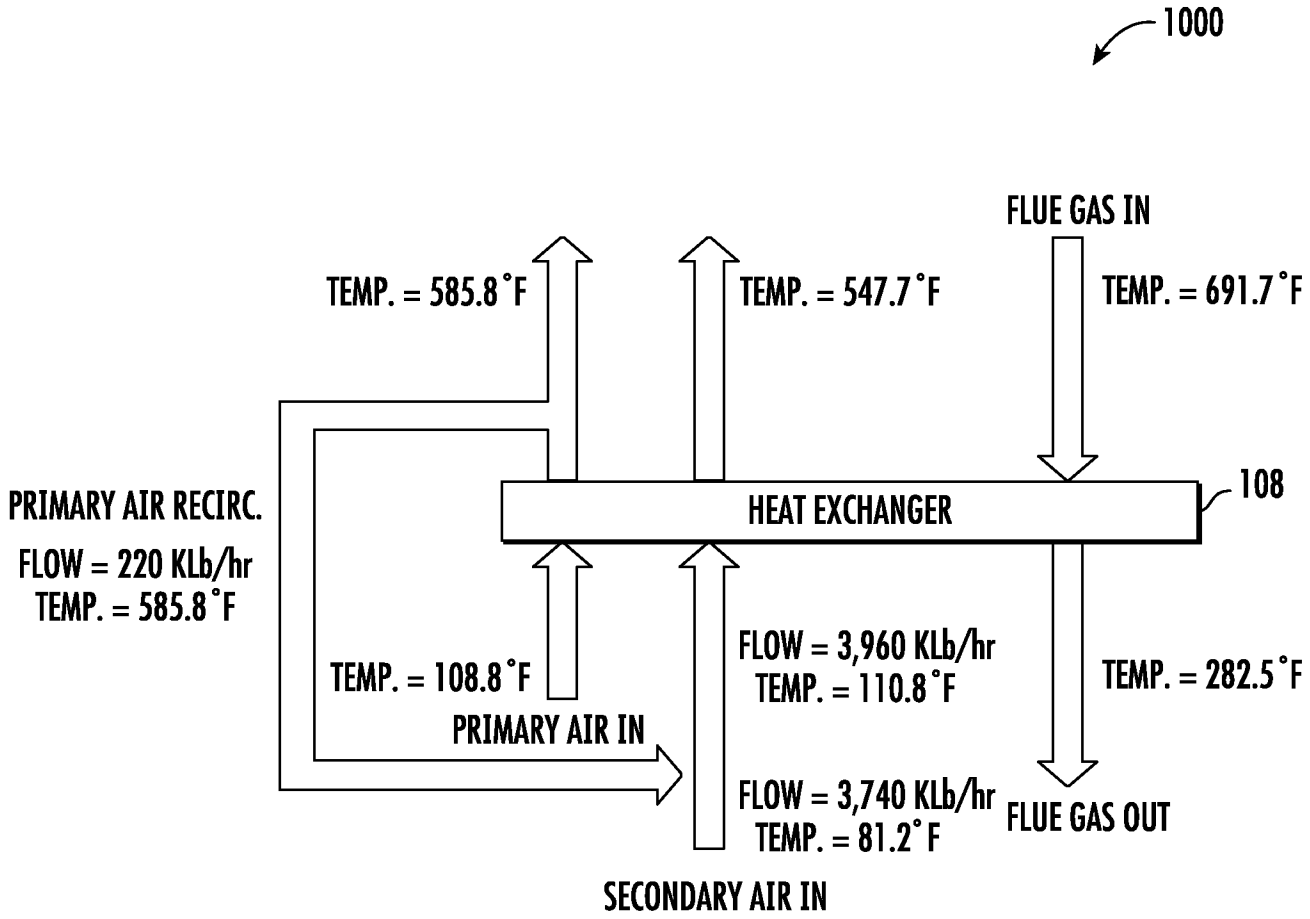
FIG. 3 is a diagram of exemplary operational characteristics of the air heater from FIG. 1.

Referring now to FIG. 3, the coal-fired power generation system 100 may operate more efficiently than typical approaches. As a function of required coal pulverizer inlet temperature, the variably tuned recirculation of hot primary air into the secondary air inlet may convert traditionally wasted energy into usable energy. For example, diagram 1000 shows a steady-state representation of the air heater 105 at full output.

The secondary air inlet temperature is illustratively increased by 29.6° F. The boiler efficiency and heat rate are improved by 0.26% & 23 Btu/kW-hr, respectively. The air heater exit gas temperature is increased by 21.6° F. Also, the increased scrubber make-up water evaporation was increased by +100 GPM.

Advantageously, the plant heat rate and boiler efficiency may be improved throughout all boiler load. The preheating of secondary air by the steam coils may be significantly reduced/eliminated throughout boiler load. The coal-fired power generation system 100 may aid in protection against acid dew point, and may aid in evaporating scrubber make-up water +80 GPM. The coal-fired power generation system 100 may reduce $CO_2$ emissions rate by +8,928 tons/year.

Moreover, the heat rate may be improved by: 44 Btu/kw-hr (with historic air preheat coil auxiliary steam usage); and 23 Btu/kw-hr (without historic air preheat coil auxiliary steam usage). Pending coal quality, boiler efficiency may be improved by +0.26%. Annual operating savings with the system may comprise: $0.40M (with historic air preheat coil auxiliary steam usage); and $0.19M (without historic air preheat coil auxiliary steam usage).

Other features relating to coal-fired power generation systems are disclosed in U.S. Pat. No. 9,457,353 to Dunst and U.S. Pat. No. 1,652,025 to Ljungstrom Fredrik, which is incorporated herein by reference in its entirety.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A coal-fired power generation system comprising:

a boiler outputting flue gas;

a coal pulverizer associated with the boiler;

a heat exchanger configured to exchange heat from the flue gas to a primary air path and a secondary air path, the primary air path coupled to the coal pulverizer and the secondary air path coupled to the boiler; and a controllable air recirculation path coupled from an output of the primary air path from the heat exchanger to an input of the secondary air path to the heat exchanger.

2. The coal-fired power generation system of claim 1 wherein the controllable air recirculation path comprises an air recirculation duct, and a damper therein.

3. The coal-fired power generation system of claim 2 comprising a controller coupled to the damper and configured to control the damper based upon respective temperatures of the output of the primary air path from the heat exchanger and an output of the secondary air path from the heat exchanger.

4. The coal-fired power generation system of claim 1 wherein the controllable air recirculation path comprises an air recirculation duct, and an expansion joint therein.

5. The coal-fired power generation system of claim 1 comprising a plurality of temperature sensors respectively coupled to the primary air path and the secondary air path.

6. The coal-fired power generation system of claim 1 wherein the input of the secondary air path to the heat exchanger is configured to receive heated ambient air; and wherein an input of the primary air path to the heat exchanger is configured to receive ambient air.

7. The coal-fired power generation system of claim 1 comprising an exhaust stack configured to receive the flue gas from the heat exchanger.

8. The coal-fired power generation system of claim 1 wherein the controllable air recirculation path has a flow rate less than 10% of a flow rate of the input of the secondary air path to the heat exchanger.

9. An air heater for a coal-fired power generation system comprising a boiler outputting flue gas, and a coal pulverizer associated with the boiler, the air heater comprising:

a heat exchanger configured to exchange heat from the flue gas to a primary air path and a secondary air path, the primary air path coupled to the coal pulverizer and the secondary air path coupled to the boiler; and a controllable air recirculation path coupled from an output of the primary air path from the heat exchanger to an input of the secondary air path to the heat exchanger.

10. The air heater of claim 9 wherein the controllable air recirculation path comprises an air recirculation duct, and a damper therein.

11. The air heater of claim 10 comprising a controller coupled to the damper and configured to control the damper based upon respective temperatures of the output of the primary air path from the heat exchanger and an output of the secondary air path from the heat exchanger.

12. The air heater of claim 9 wherein the controllable air recirculation path comprises an air recirculation duct, and an expansion joint therein.

13. The air heater of claim 9 comprising a plurality of temperature sensors respectively coupled to the primary air path and the secondary air path.

14. The air heater of claim 9 wherein the input of the secondary air path to the heat exchanger is configured to receive heated ambient air; and wherein an input of the primary air path to the heat exchanger is configured to receive ambient air.

15. The air heater of claim 9 comprising an exhaust stack configured to receive the flue gas from the heat exchanger.

16. The air heater of claim 9 wherein the controllable air recirculation path has a flow rate less than 10% of a flow rate of the input of the secondary air path to the heat exchanger.

17. A method for operating a coal-fired power generation system comprising a boiler outputting flue gas, and a coal pulverizer associated with the boiler, the method comprising:

exchanging heat from the flue gas to a primary air path and a secondary air path using a heat exchanger, the primary air path coupled to the coal pulverizer and the secondary air path coupled to the boiler; and controlling an air recirculation path coupled from an output of the primary air path from the heat exchanger to an input of the secondary air path to the heat exchanger.

18. The method of claim 17 wherein the air recirculation path comprises an air recirculation duct, and a damper therein.

19. The method of claim 18 comprising controlling the damper based upon respective temperatures of the output of the primary air path from the heat exchanger and an output of the secondary air path from the heat exchanger.

20. The method of claim 17 wherein the air recirculation path comprises an air recirculation duct, and an expansion joint therein.

21. The method of claim 20 comprising sensing temperature values from a plurality of temperature sensors respectively coupled to the primary air path and the secondary air path.

* * * * *